United States Patent [19]

Oh

[11] Patent Number: 5,021,709

[45] Date of Patent: Jun. 4, 1991

[54] SUPPORTING STRUCTURE FOR AN ELECTRON GUN HEATER

[75] Inventor: Tae-sik Oh, Suwon, Rep. of Korea

[73] Assignee: Samsung Electron Devices Co. Ltd., Rep. of Korea

[21] Appl. No.: 461,914

[22] Filed: Jan. 8, 1990

[30] Foreign Application Priority Data

Jun. 5, 1989 [KR] Rep. of Korea ..... 89-7827

[51] Int. Cl.[5] ..... H01J 29/82; H01J 9/18

[52] U.S. Cl. ..... 313/456; 313/417; 313/446; 445/29; 445/34; 445/67

[58] Field of Search ..... 313/417, 446, 456; 445/29, 34, 67

[56] References Cited

U.S. PATENT DOCUMENTS 4,931,691 6/1990 Hale ..... 313/446 X

*Primary Examiner*—Sandra L. O'Shea

*Attorney, Agent, or Firm*—Leydig, Voit & Mayer

[57] ABSTRACT

An electron gun heater supporting structure includes a pair of supporting pieces respectively mounted on separate opposed glass beads of an electron gun and U-shaped connecting pieces disposed between the pair of supporting pieces for welding terminals of a heater thereto, the connecting pieces including position determining elements for determining the positions of the connecting pieces relative to the supporting pieces for welding them together. According to the present invention, the welding positions can be exactly determined and the uniformity of heater positions can be realized.

5 Claims, 4 Drawing Sheets

SUPPORTING STRUCTURE FOR AN ELECTRON GUN HEATER

FIELD OF THE INVENTION

The present invention relates to a supporting structure for the heater of an electron gun of a cathode ray tube and, particularly, to an improved heater supporting structure in which heater mounting is easy and the installed positions of the heaters are uniform, thereby decreasing variations in the positional bias of the heater to a great degree.

BACKGROUND OF THE INVENTION

The conventional method of placing a heater which is the heat source of the cathode of an electron gun of a cathode ray tube into a sleeve described below.

As shown in FIG. 1A, a supporting piece 12 secured to a bead glass 11 is eccentric from the center of a sleeve 14 by as much as the thickness of a U shaped connecting piece 15 of a heater. The sleeve 14 is supported by a protection tube 13. In such a state, a terminal 16*a* of a heater 16, which is constructed as shown in FIG. 1B, is welded to the side of the connecting piece 15 that is disposed nearer to the center of the sleeve 14, so that the heater 16 is placed at the center of the sleeve. In the succeeding processes, a bridge portion B of the U shaped connecting piece 15 is removed as shown in FIG. 1B.

In such a heater supporting structure, when the heater supporting piece 12 is secured to the based glass 11, the heater connecting piece 15 has to be disposed eccentrically relative to the center of the sleeve 14 by as much as its own thickness, and this requires a critical dimensional control. Further, when the heater 16, which is welded to a heater connecting piece 15, is inserted into the sleeve 14, and when the heater connecting piece 15 is welded to one side of the heater supporting piece 12, the heater 16 is placed at the center of the sleeve 14, in the left-right direction of FIG. 1A, due to the fact that the connecting piece 15 makes facial contacts to the supporting piece 12 on the left and right sides as shown in FIG. 1A.

However, in the up and down direction of FIG. 1A, there is no way of preventing movement of the connecting piece 15 relative to the supporting piece 12, and therefore, the positional uniformity depends on the skillfulness of the worker.

SUMMARY OF THE INVENTION

Therefore, it is the object of the present invention to provide an improved electron gun heater supporting structure in which the coupling of the heater is easy and overall positional uniformity of the heaters is realized.

In achieving the above object, the electron gun heater supporting structure according to the present invention comprises at least one pair of supporting pieces opposingly secured at the respective inner faces of glass beads of the electron gun, U shaped connecting pieces disposed between and for welding to the respective supporting pieces and to terminals of a heater position determining means for determining the position of the connecting pieces relative to the supporting pieces for their welding.

In the heater supporting structure according to the present invention, a restricting wall is formed in the U shaped connecting piece so that the U shaped connecting piece is kept at the exact center between the pairs of supporting pieces for supporting the connecting piece, the bridge at the center of the U shaped connecting piece being removed after completion of the welding of the heater. Therefore, when the connecting piece is welded to the supporting piece, exact positioning of the connecting piece can be achieved regardless of the skillfulness of the worker. Accordingly, the overall deviation of the connecting pieces relative to the supporting pieces is reduced, thereby improving the reliability of the products.

BRIEF DESCRIPTION OF THE DRAWINGS

The above object and other advantages of the present invention will become more apparent by describing in detail a preferred embodiment of the present invention with reference to the attached drawings in which.

DESCRIPTION OF THE PREFERRED EMBODIMENTS

Figure 1A:
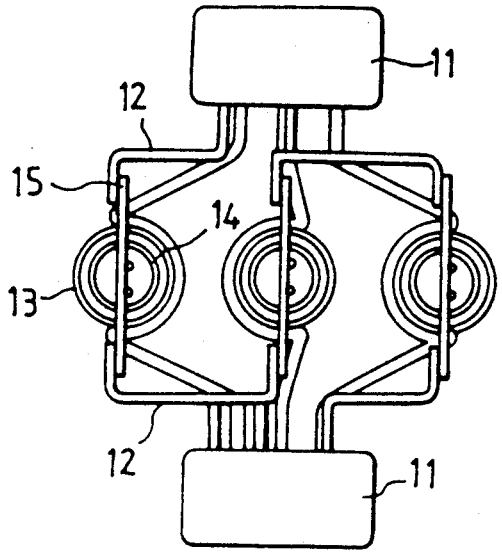
FIG. 1A (Prior Art)
FIG. 1A is a bottom view of the installation of a conventional electron gun cathode.
Figure 1B:
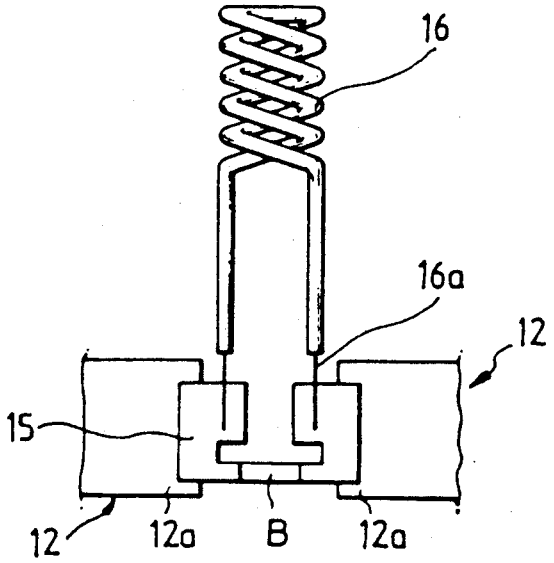
FIG. 1B (Prior Art)
FIG. 1B is a frontal, partial view of the cathode heater and the connecting piece for supporting the cathode in a conventional electron gun.
Figure 2:
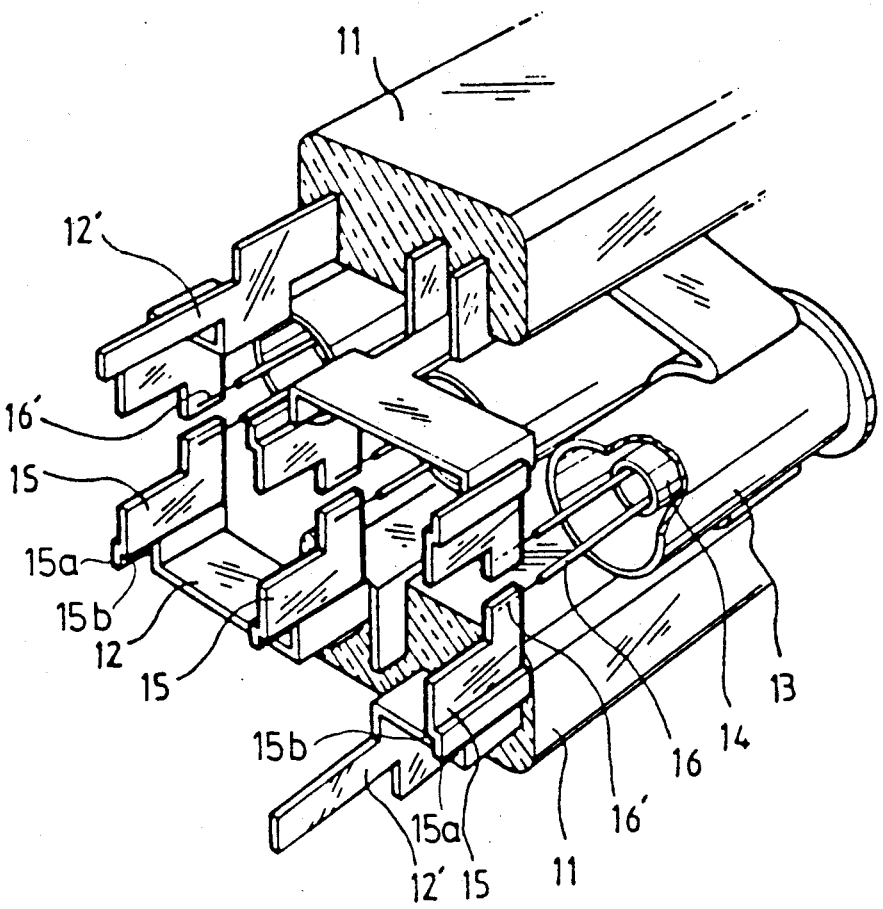
FIG. 2 is a perspective view of a heater supporting piece according to the present invention.
Figure 3:
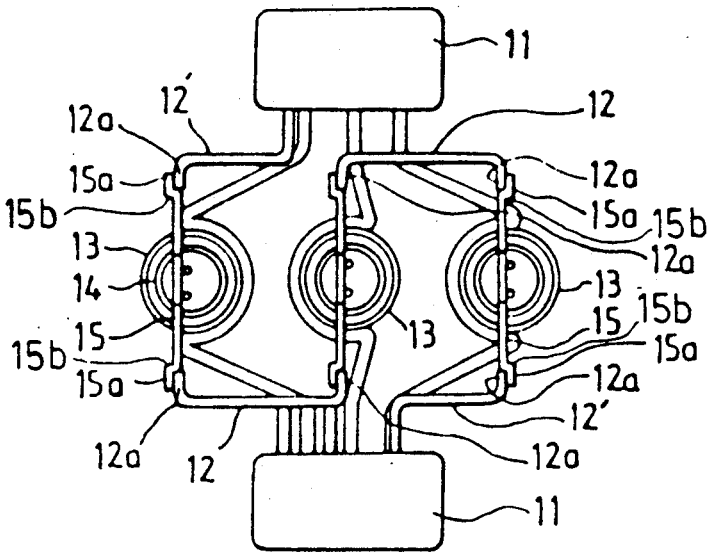
FIG. 3 is a bottom view of a heater supporting piece for an electron gun of a cathode ray tube.

FIGS. 2 and 3 illustrates a heater supporting piece for use in an electron gun of a cathode ray tube. As shown in these drawings, two supporting pieces 12', 12 respectively having one and a pair of welding ends 12*a* are mounted in each of the two glass beads 11. The respective glass beads 11 are disposed at the opposite sides of the electron gun. The three welding end 12*a* extending from the supporting pieces at each glass bead are arranged to have the same spacings as sleeves 14. These welding ends 12*a* opposingly face one another and have predetermined gaps between them.

Further, a U shaped connecting piece 15 is disposed between each of the pairs of the welding ends 12*a* of the supporting pieces extending from opposed glass beads. The heater terminals 16*a* of each heater are welded to one of the connecting pieces. The connecting pieces 15 include offset welding ends 15*a* that overlap and are welded to the welding ends 12*a* of the supporting pieces 12 and 12'.

Figure 4A:
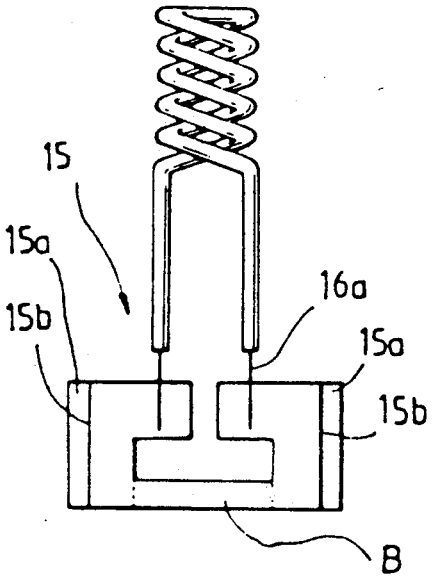
FIG. 4A is a frontal, partial view of a heater of an electron gun and the connecting piece for supporting it.
Figure 4B:
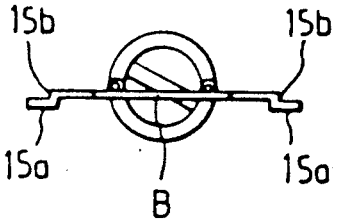
FIG. 4B is a bottom view of a heater-connecting piece.

As most clearly shown in the front and bottom view of FIGS. 4A and 4B, restricting walls 15*b* which are formed in the bending connecting pieces 15 in the shape of Z or a step to form the offsets are disposed on on the opposite portions 15*a* of the connecting pieces 15. The distance between each pair of the restricting walls 15*b* is equal approximately to the gap between each pair of the welding ends 12*a* extending from opposed glass beads. Accordingly, as shown in FIG. 3, each pair of the restricting walls 15*b* is securely placed between the respective pairs of welding ends 12*a* for welding.

After placing the connecting pieces 15 between the welding ends 12*a*, the terminals 16*a* of the heater 16 are welded to the connecting pieces 15 prior to the welding of the connecting pieces 15 to the welding ends 12*a*. Upon completion of the welding of the connecting piece 15, the bridges B forming the middle portions of the connecting pieces 15 between the terminals 16*a* of the respective heaters 16 are removed at a finishing step. Removal of the bridges is necessary to electrically separate the respective terminals of each heater.

The device of the present invention as described above includes position determining means for determining the position of the connecting piece relative to the welding ends, these position determining means being disposed at the opposite ends of each of the connecting pieces which are welded to the supporting pieces. Therefore, the welding of the connecting piece to the supporting piece becomes easier. That is, the pairs of opposing restricting walls the connecting pieces contact the welding ends of the supporting pieces, with the result that the welding positions of the connecting pieces on the welding ends are naturally determined. Consequently, this the worker does not have to decide the welding position in carrying out the welding process, and the problems accompanied therewith are also solved.

Figure 5A:
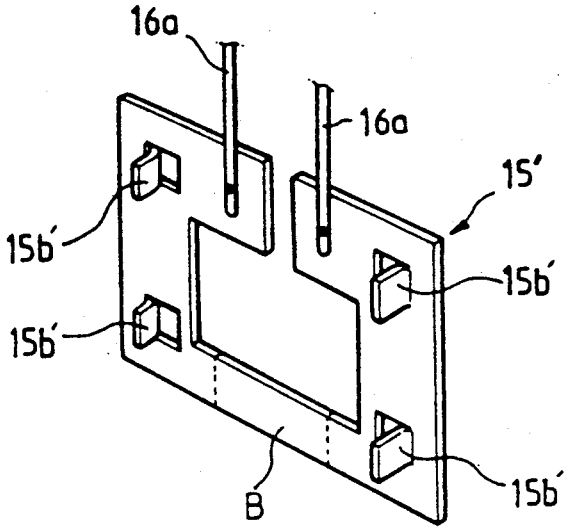
FIGS. 5A and 5B are perspective view of other embodiments of the connecting piece for securing a heater according to the present invention.
Figure 5B:
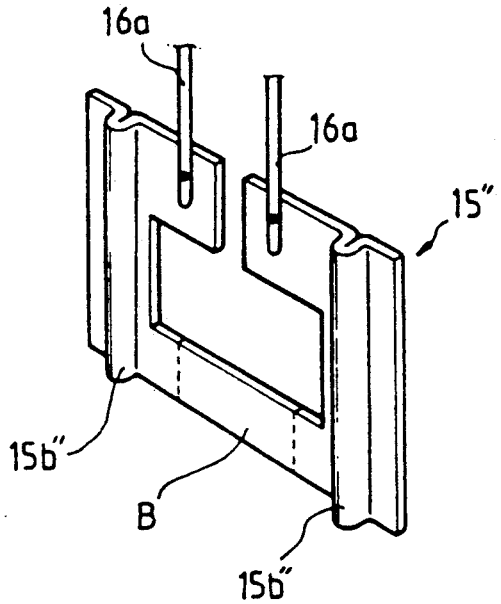

Meanwhile, the connecting pieces including a position determining means can be modified to the forms which are illustrated in FIGS. 5A and 5B. That is, instead of the step-shaped bending form 15*b*, parts of the connecting pieces 15′ are cut in a U form, and the cut piece is bent outwardly, thereby forming restricting walls 15*b*′ as shown in FIG. 5A. Another type of modified restricting walls 15*b*″ can be formed of U shaped folds in the connecting pieces 15″ as shown in FIG. 5B.

As described above, the heater supporting device according to the present invention assures that the welding position of the connecting pieces for supporting and securing the heater is mechanically determined and set, and therefore, compared with the conventional heater supporting structure which has no position determining means, the heater supporting structure according to the present invention adds convenience to carrying out the welding process. Further, positional uniformity of the heater can be realized throughout the products, and, therefore, variations in characteristics due to the positional deviations of the heaters can be decreased.

What is claimed is:

1. An electron gun heater supporting structure comprising:

a pair of supporting pieces, each supporting piece being mounted on a different one of two opposing glass beads of an electron gun; and a U shaped connecting piece disposed between the pair of supporting pieces for welding the terminals of a heater thereto and for welding at opposing ends to the pair of supporting pieces, said supporting pieces including position determining means for determining the position of the ends of the connecting piece relative to the pair of supporting pieces for welding the connecting piece to the pairs of supporting pieces.

2. The electron gun heater supporting structure as claimed in claim 1 wherein said position determining means comprises restricting walls proximate the opposite ends of said connecting piece and separated by approximately the distance between the pair of supporting pieces for engaging the respective supporting pieces and thereby determining the welding positions.

3. The electron gun heater supporting structure as claimed in claim 2 wherein said restricting walls comprise cut portions of said connecting piece bent to protrude tranversely from said connecting piece.

4. The electron gun heater supporting structure as claimed in claim 2 wherein said restricting walls comprise U-shaped folds in said connecting pieces.

5. The electron gun heater supporting structure as claimed in claim 2 wherein said restricting walls comprise step-shaped bends in said connecting pieces.

* * * * *